US006250345B1

(12) United States Patent
Allwein et al.

(10) Patent No.: US 6,250,345 B1
(45) Date of Patent: Jun. 26, 2001

(54) SECONDARY CONTAINMENT AND DRAINAGE SYSTEM FOR ABOVE-GROUND STORAGE TANKS

(75) Inventors: Steven P. Allwein, Severna Park, MD (US); Stephen C. Macy, The Woodlands, TX (US)

(73) Assignee: Containment Solutions, Inc., Conroe, TX (US)

( * ) Notice: Subject to any disclaimer, the term of this patent is extended or adjusted under 35 U.S.C. 154(b) by 0 days.

(21) Appl. No.: 09/593,213

(22) Filed: Jun. 14, 2000

(51) Int. Cl.[7] ..... B65B 1/04

(52) U.S. Cl. ..... 141/86; 141/88; 141/311 A; 222/108; 220/4.12; 220/465

(58) Field of Search ..... 141/86, 88, 311 A; 220/571, 4.12, 565, 465; 222/108

(56) References Cited

U.S. PATENT DOCUMENTS

| | | | | |
|---|---|---|---|---|
| 4,815,621 | | 3/1989 | Bartis . | |
| 4,895,272 | | 1/1990 | De Benedittis et al. . | |
| 5,058,633 | | 10/1991 | Sharp . | |
| 5,197,627 | | 3/1993 | Disabato et al. . | |
| 5,203,386 | | 4/1993 | Harp . | |
| 5,346,093 | | 9/1994 | De Benedittis et al. . | |
| 5,381,923 | | 1/1995 | O'Dea . | |
| 5,538,052 | | 7/1996 | Harp . | |
| 5,564,588 | | 10/1996 | Reese . | |
| 5,570,714 | | 11/1996 | Magish . | |
| 5,702,026 | * | 12/1997 | Lindquist | 220/745 |
| 5,769,109 | | 6/1998 | Stanton et al. . | |
| 5,884,709 | * | 3/1999 | Evans et al. | 222/108 |
| 6,039,123 | * | 3/2000 | Webb . | |

* cited by examiner

*Primary Examiner*—Steven O. Douglas
(74) *Attorney, Agent, or Firm*—Shaw Pittman

(57) ABSTRACT

A secondary containment and drainage system for an above-ground storage tank is described, in which small quantities of leaked or overflowing liquid are temporarily stored in a housing above the internal storage tank. This fluid can be easily removed from the housing for re-use or at least removed without the time consuming process of emptying and cleaning the overfill dike that surrounds the tank. When greater quantities of liquid leak from the input port of the storage tank, the overflowing liquid is drained into the dike through a drainage pipe that extends from the housing, through the internal storage tank, and into the dike. The dike is enclosed by a roofing structure that forms a seal to prevent contamination when liquid is drained into the dike.

18 Claims, 7 Drawing Sheets

SECONDARY CONTAINMENT AND DRAINAGE SYSTEM FOR ABOVE-GROUND STORAGE TANKS

FIELD OF THE INVENTION

The present invention relates generally to above-ground storage systems for liquids and, more particularly, to a storage system having a secondary containment dike and an overflow drain within the primary tank to divert fluid to the secondary containment dike.

BACKGROUND OF THE INVENTION

In accordance with EPA regulations, an above-ground storage tank system for containing fuels, potentially hazardous fluids, or any other liquids that would create environmental problems if released into the ground must include a secondary containment device capable of storing at least 110% of the fluid that can be contained in the storage tank. The secondary containment device is typically comprised of a dike that at least partially surrounds the tank to prevent ground contamination that may occur from leaks and overfills.

Several containment system designs are known for storing fluid that was spilled or overfilled from an internal storage tank. U.S. Pat. No. 5,203,386 ("the '386 patent") discloses a storage system in which a secondary container having an attached hood completely surrounds an internal storage tank. The hood over the dike prevents rain or ambient precipitation and trash from entering the dike. As shown in FIGS. 1 and 2 herein, which correspond with FIGS. 1 and 2 of the '386 patent, the internal storage tank is filled by opening a door 10 on housing 12 formed at the top of the structure to gain access to one of the internal tank ports 20, 22, 24. The housing 12 is located above input ports but is not connected to the internal tank. If fluid leaks from one of the ports or is spilled within the housing 12, it runs along the exterior of the internal tank 14, within the sloping side walls 16 of hood 18, and into the dike 26.

U.S. Pat. No. 4,895,272 ("the '272 patent") describes another liquid storage system having a roof structure that extends from a point along the upper side of the internal storage tank to the sides of the dike. As shown in FIGS. 3–4, drainage structure 40 is a passageway that extends from the side of housing 38, through the roof structure 34, and into storage space 42 in the external containment vessel 32. If liquid is spilled or is overflowing from the internal tank, it runs within the passageway 46 and along the exterior of the internal storage tank.

In many applications that require an above-ground storage tank apparatus, it would be advantageous to recover any spilled or overflowing fluid for use. However, this is not possible with the liquid storage system described in the '272 patent, because the roof structure does not provide a liquid-tight seal to prevent spilled liquid from contamination. In most circumstances, spilled liquid cannot be re-used if it contacts with water in the external containment vessel 32, and it then must be disposed as a hazardous material. As for the containment system described in the '386 patent, it is difficult for an operator to detect whether any fluid has leaked from an input port, because there is no bottom portion to the housing 28 to collect the spilled fluid.

Even if the spilled liquid does not become contaminated in the systems disclosed in the '272 and '386 patents, it must be drained or pumped from the dikes. The interior of the dike must then be cleaned, which can be a difficult and time-consuming process. On most occasions, only a small quantity of fluid leaks from an input port of the internal storage tank. Accordingly, there is a need for an above-ground storage tank apparatus that overcomes the problems of contamination and the labor-intensive process required for recovering fluid when only a small portion of fluid leaks from an input port of the internal tank.

For some applications, it is also advantageous to pressure test the storage space between external containment vessel and the internal storage tank. Pressure testing assures that the external containment area is properly sealed such that any spilled fluid does not become contaminated. However, the containment systems described in both the '272 and the '386 patents do not readily allow an operator to conduct pressure testing. Accordingly, there is also a need for a storage tank apparatus that provides for pressure testing.

SUMMARY OF THE INVENTION

The present invention provides a secondary containment and drainage system for an above-ground storage tank in which small quantities of leaked or overflowing liquid are temporarily stored in the housing above the internal storage tank. This fluid can be easily removed from the housing for re-use or at least removed without the time consuming process of emptying and cleaning the dike. When greater quantities of liquid leak from the input port of the storage tank, the overflowing liquid is drained into the dike through a drainage pipe that extends through the internal storage tank and protrudes into the housing. The drainage pipe empties into the dike that is beneath and surrounding the internal storage tank. The drainage pipe is positioned to allow a certain quantity of liquid to remain in the housing, but prevents any liquid from overflowing out of the housing of the storage system.

The housing on top of the storage tank and all vents are attached to a plate. The plate is attached to a roof structure, which extends to the top of the walls of the dike. The plate and roof structure are attached, preferably by welding, to form a liquid-tight seal. This provides containment completely surrounding the internal storage tank to prevent contamination.

An object of the present invention is to provide an above-ground storage tank apparatus comprising an internal storage tank for storing liquid injected through an input port protruding therefrom, a secondary containment vessel surrounding the internal storage tank, a drain pipe extending through and protruding from the internal storage tank at a first and second location, and a spill box connected to the internal storage tank and surrounding the input port and the drain pipe protruding from the internal storage tank. The spill box stores a first quantity of liquid that is spilled during injection into the internal storage tank, and amounts of liquid greater than the first quantity of liquid are drained from the spill box through the drain pipe and into a containment area between the secondary containment vessel and the internal storage tank.

A further object of the invention is to provide an above-ground containment system having a sealed secondary containment area. The system includes an internal storage tank for storing liquid injected through an input port protruding therefrom, a secondary containment vessel surrounding the internal storage tank for storing liquid spilled from the input port, a drain pipe extending through and protruding from the internal storage tank at a first location near the input port and a second location in a secondary containment area between the internal storage tank and the secondary containment vessel, a spill box connected to the internal storage tank and surrounding the input port, and a roofing structure extending from sides of the spill box to walls of the secondary containment vessel to seal the secondary containment area. The seal of the containment system can be pressure tested by applying pressure through the drain pipe at the first location.

DETAILED DESCRIPTION OF THE PREFERRED EMBODIMENTS

Figure 2:
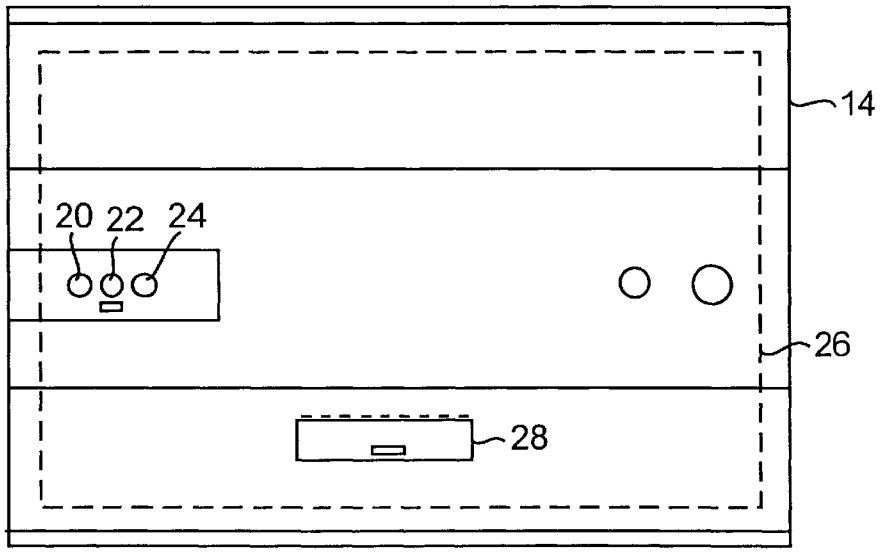
PRIOR ART FIG. 2
FIG. 2 is a top view of the conventional containment system of FIG. 1.
Figure 1:
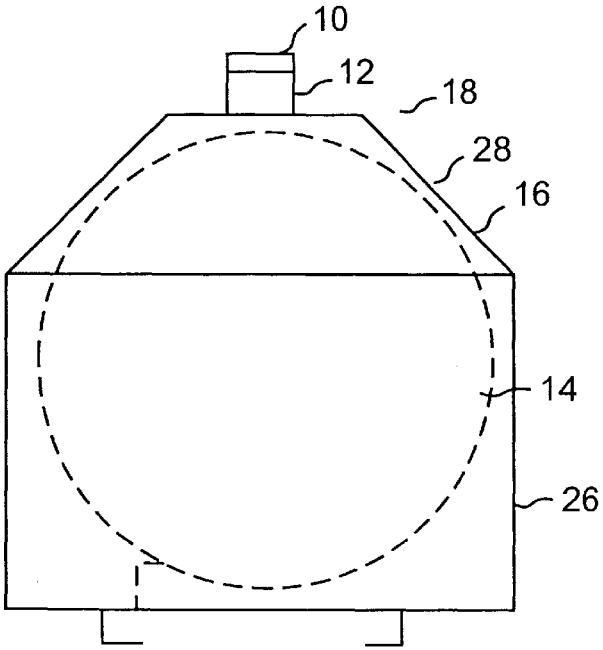
PRIOR ART FIG. 1
FIG. 1 is an end elevation view of a conventional containment system.
Figure 3:
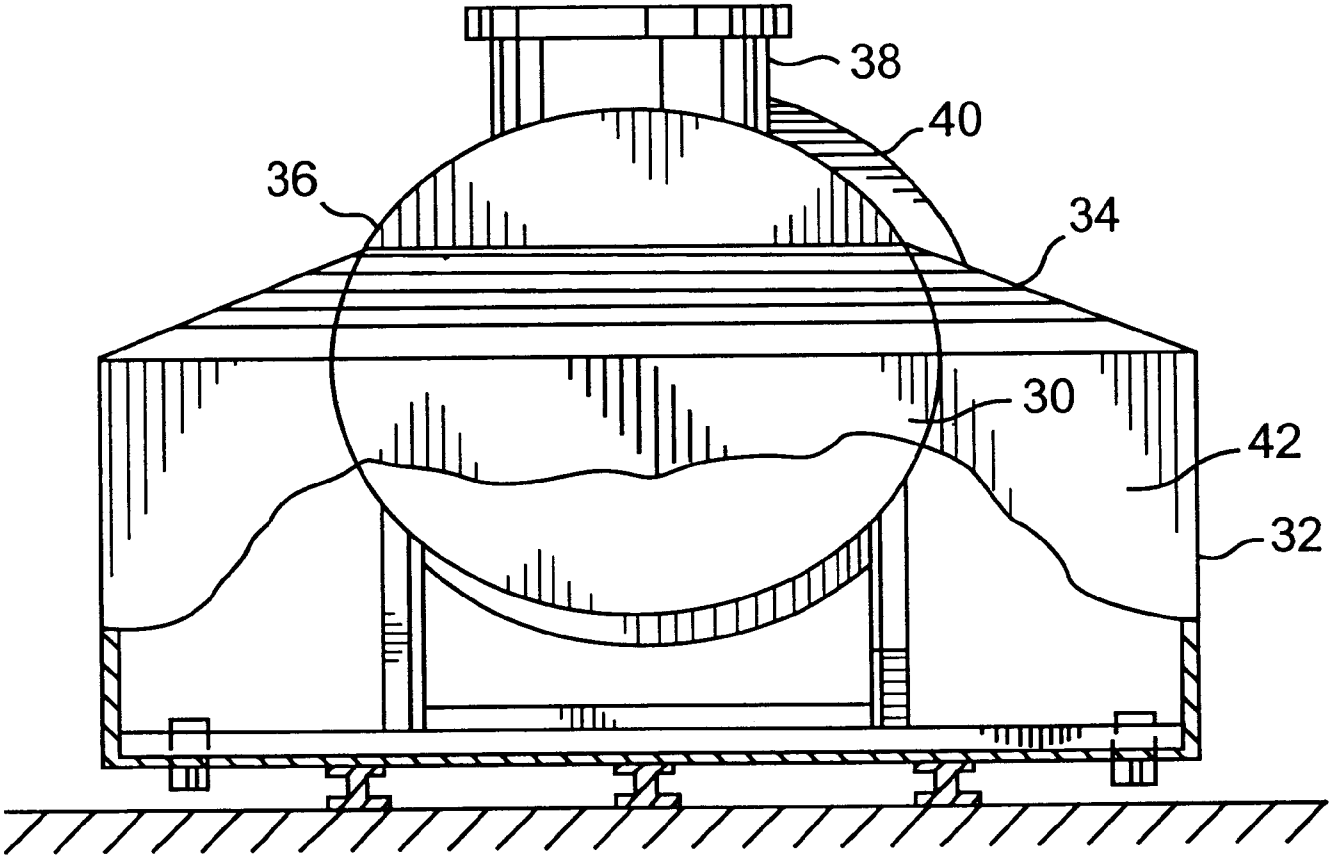
PRIOR ART FIG. 3
FIG. 3 is a side view of a conventional storage system.
Figure 4:
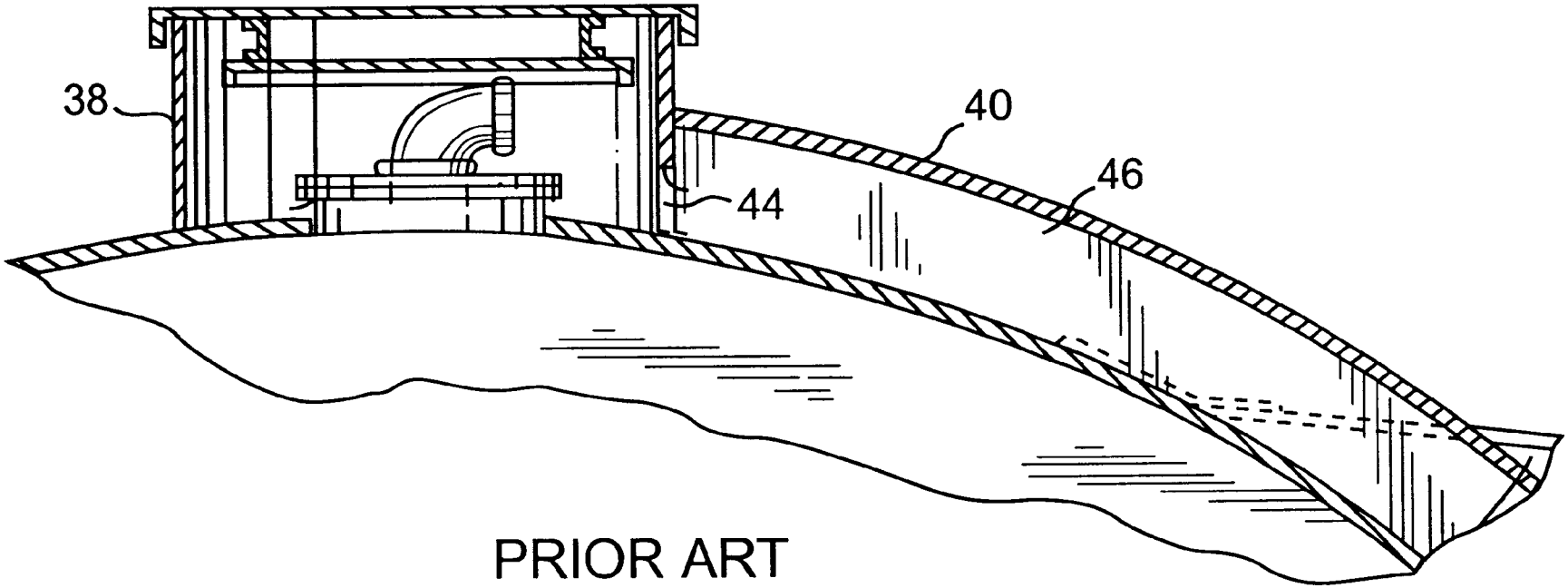
PRIOR ART FIG. 4
FIG. 4 is an enlarged sectional view of an upper portion of the conventional storage system in FIG. 3.
Figure 5:
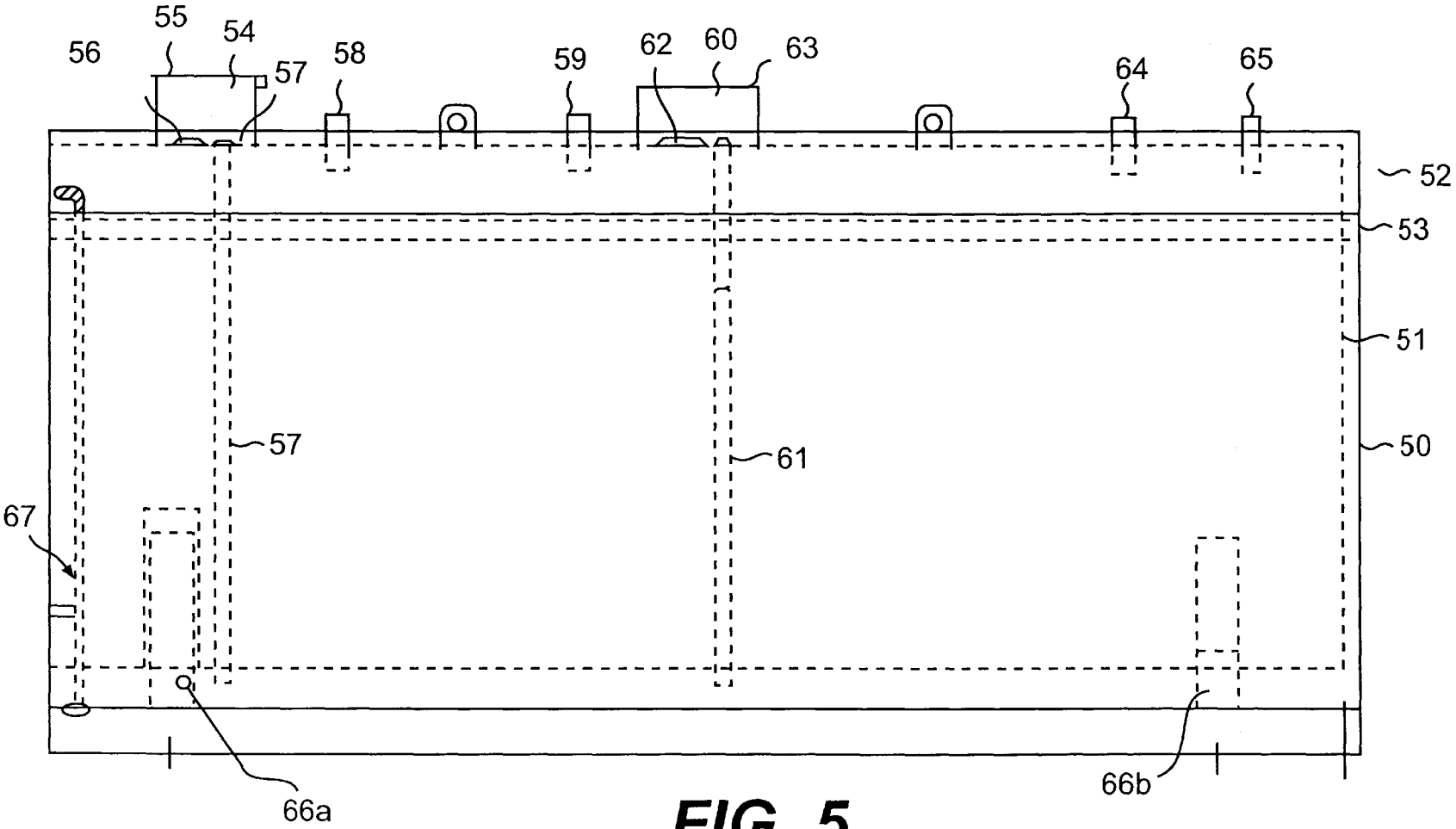
FIG. 5 is a side view of a containment system according to a preferred embodiment of the present invention, partially in section.

A side view of the storage tank apparatus according to a preferred embodiment of the present invention is provided in FIG. 5. External containment vessel or dike 50 surrounds the lower portion of internal storage tank 51, shown in dashed lines. Roofing structure 52, attached to the dike 50 at junction 53, covers the top portion of the internal storage tank 51 such that the external containment vessel 50 in conjunction with the roofing structure 52 encloses the internal storage tank 51.

Figure 8:
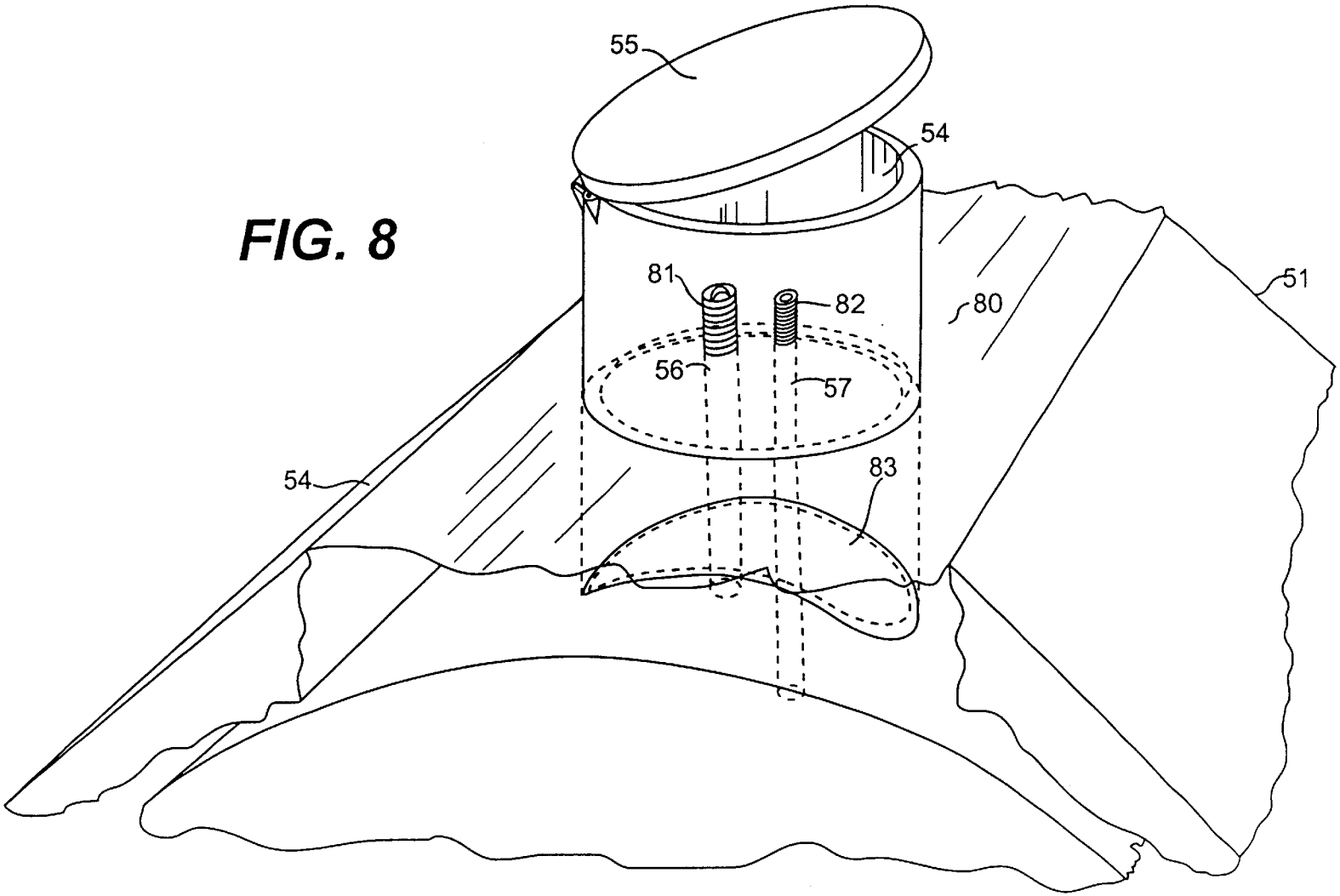
FIG. 8 is an enlarged perspective view of the spill box in the containment system of FIG. 5.

Spill box 54 is attached to internal storage tank 51 and protrudes through roofing structure 52. Spill box 54 is connected to plate 80 as shown in FIG. 8, preferably by welding. Plate 80 is a part of the roofing structure. As described in further detail below, cap 55 of spill box 54 opens to allow an operator to fill the internal storage tank 51 with liquid through input port 56, and spilled or overfilled fluid can be drained from the spill box in some circumstances through drain pipe 57.

Gauge 58 also extends from the internal storage tank 51 and protrudes through plate 55 of roofing structure 52 for easy monitoring by an operator. Gauge 58 can be a mechanical or an electronic fill meter. The gauge can be optionally attached to an alarm to indicate when the internal storage tank is filled.

Vent 59 also extends from the internal storage tank 51. The vent is typically comprised of a 2–4" diameter pipe that protrudes several feet above the tank and roofing structure. The vent is preferably a 4" diameter pipe, although it can be of any size. Likewise, e-vent 63 has a diameter of 4–10", and protrudes from the roofing structure 52 to provide venting from the dike 50. E-vent 63 is preferably an 8" diameter pipe.

Internal storage tank 51 is also connected to a larger venting structure, which includes venting spill box 60. The venting structure allows for the emergency venting of gases from the external containment vessel through venting pipe 61, and from the internal storage tank through port 62. As such, the venting structure can include a relatively loose-fitting venting cover 64. This venting structure will be described in further detail below.

Finally, an audible alarm 65 may protrude from the top of the roofing structure to alert an operator when the internal storage tank is overfilled. At the bottom of the tank assembly, supports 66*a*, and 6*b* are placed on top of the external containment vessel or dike 50 to hold the internal storage tank 61 in place. Pipe 67 is attached to a collection sump (not shown) to remove excessive fluid that collected within the secondary containment area.

Figure 6:
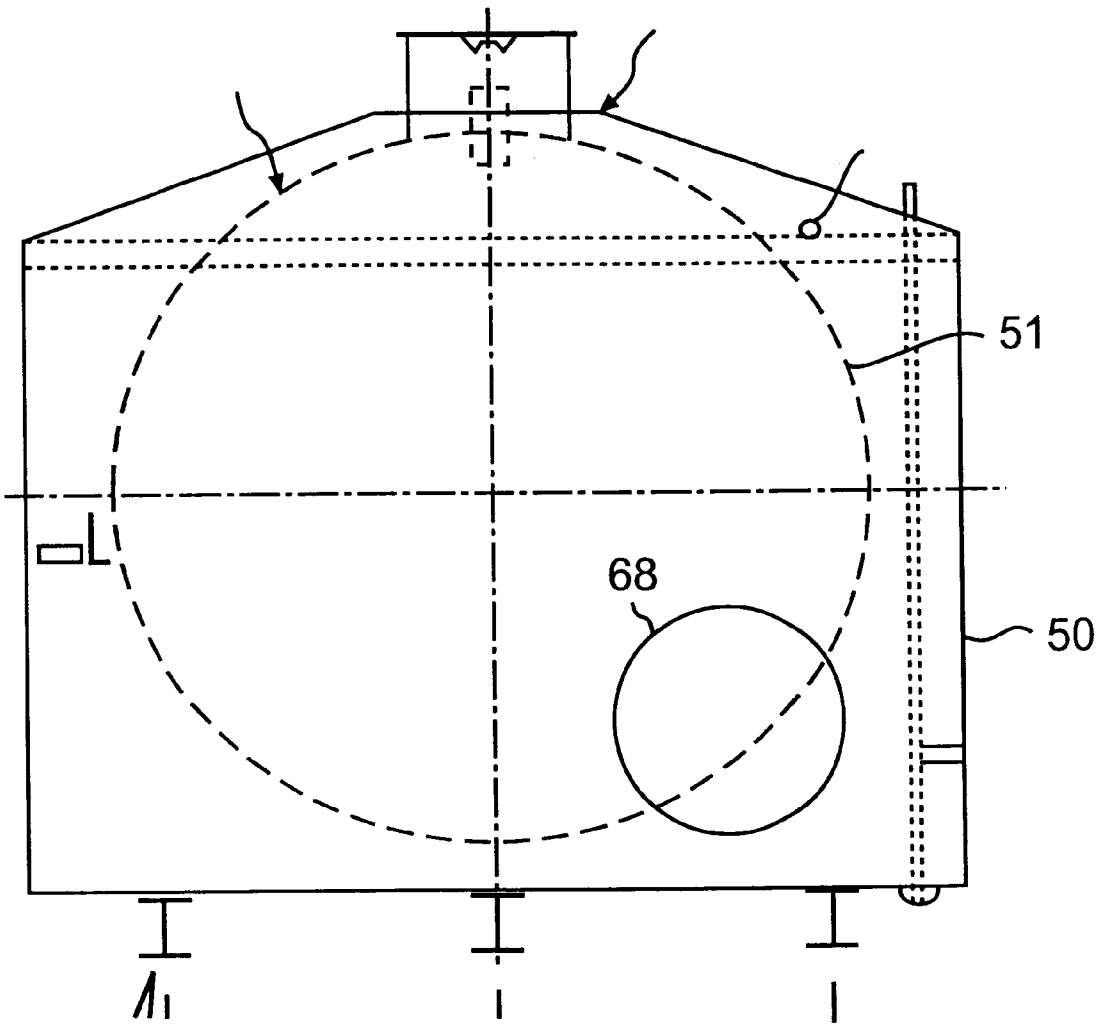
FIG. 6 is an end view of the containment system of FIG. 5.

An end view of the containment apparatus is provided with reference to FIG. 6. Manway 68 is located in an end wall of the external containment vessel 50 to allow an operator to gain access to the containment area outside of the interior storage tank. Manway 68 is of sufficient size such that an operator can clean the walls of the external containment vessel 50 and the exterior walls of storage tank 51 after spilled or overflowing fluid is pumped from the containment area. In the preferred embodiment, the manway consists of a bolted and gasket cover. When the manway is closed, the containment area is then sealed to prevent contamination. The manway is preferably located at least several inches above the bottom of the side wall, such that any fluid that remains in the containment area after pumping is not spilled outside of the containment system.

Figure 7:
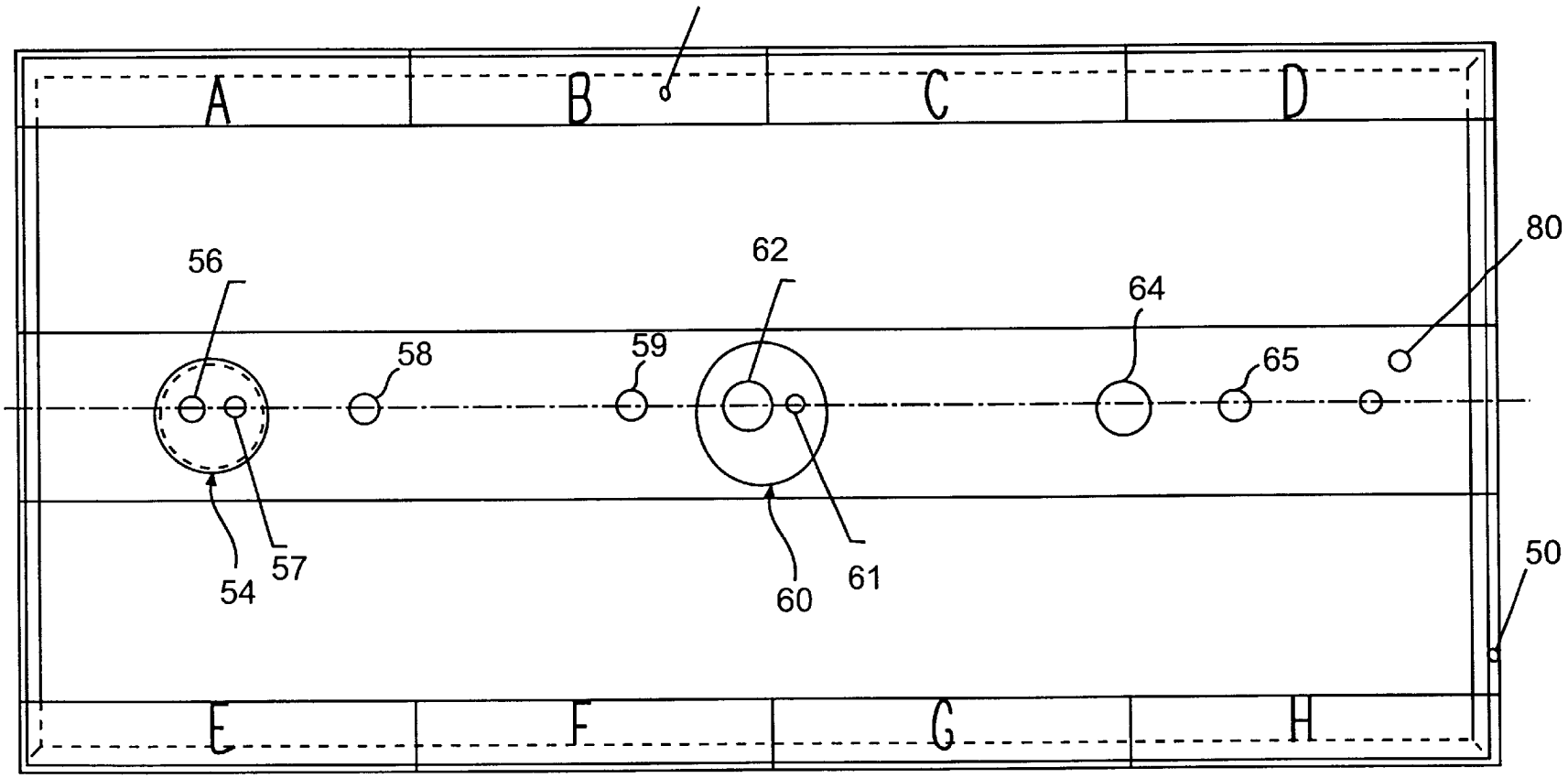
FIG. 7 is a top view of the containment system of FIG. 5.

FIG. 7 provides a top view of the roofing structure 52, plate 80, and venting spill boxes 54 and 60. Preferably, the plate 80 is a flat, rectangular metal piece that is the same length as the dike, and is approximately 3' wide. The plate has a series of cut-outs that are of the same dimensions as the diameters of the spill boxes, vents, and gauges that protrude from the internal storage tank. In the preferred embodiment, plate 80 is affixed to a shield through welding, which in turn is welded to the side of dike 50. The shield may preferably overhang the dike walls by at least 1 ".

An enlarged view of the spill box 54 of the interior tank is provided in FIG. 8. As can be seen from the dashed lines, the spill box continues through the plate 80, and ends at interior storage tank 51. Input port 56 begins at the top of the interior storage tank and protrudes through spill box base 83. Input port 56 is a threaded pipe 81 to allow for a fixed connection when an operator injects fluid into the storage tank. Drain pipe or overfill tube 57 begins at the bottom of the overfill containment area as shown in FIG. 5, and protrudes through the interior storage tank and the spill box base 83. Accordingly, liquid that enters through the overfill tube is drained directly from the spill box to the containment area surrounding the interior storage tank.

Drain pipe 57 is raised a predetermined distance above spill box base 83. If only a small quantity of liquid is spilled from the input port 56, the liquid remains in the spill box. When the level of liquid in the spill box reaches a height greater than the height of the drain pipe 57, it is drained directly to the containment area. In an alternative embodiment, an alarm is provided in the spill box for indicating the occurrence of a spill into the spill box 54. In a further embodiment, a second alarm is provided for indicating when the liquid in the spill box reaches a height greater than the height of the drain pipe 57 (not shown). The sensor for the second alarm can be located within the spill box and above the drain pipe, or at the bottom of the containment area in the dike.

During manufacture and assembly, drain pipe 57 can be positioned according to the amount of fluid that the operator desires to be left in the spill box before draining into the containment area. In an alternative embodiment, drain pipe 57 can be equipped with an extendable adjustment piece that allows an operator to lengthen or shorten height of the drain pipe within the spill box.

Drain pipe 57 is threaded at the tip 82 to allow for a fixed connection for pressure testing. If the pressure test is successful, air that is forced through the drain pipe remains in the containment area. By detecting the buildup of pressure, an operator can test whether the secondary containment device prevents contamination of any spilled liquid. The drain pipe 57 can also be connected to a vacuum system to remove any remaining moisture in the containment area after spilled liquid is pumped out.

Vent box 60 has a similar structure as spill box 54. Accordingly, to perform a pressure test, either vent pipe 61 or drain pipe 57 must first be closed. As can be readily seen, there are several advantages to the configuration of the secondary containment and drainage system of the present invention. The internal drain pipe is positioned to allow spilled, uncontaminated liquid to remain in the spill box. This can be easily removed and reused without having to pump out and clean the containment area defined by the external containment vessel. Another advantage of the internal drain pipe design is that also reduces the risks of vandalism.

There are also other advantages to the storage system when liquid enters the secondary containment area. When an alarm is installed, the operator will be notified if there is a leak or overfill at the input port. If a great volume of liquid is spilled, the liquid travels directly downward into the containment area, where it is protected from contamination and isolated from the external environment. A second alarm can be installed to notify the operator when a spill has overflowed into the secondary containment area. The roof structure is connected to the side walls of the external containment vessel to completely surround the containment area. If liquid is spilled from the spill box, it is reusable. Further, if the internal storage tank develops a leak, the escaped liquid will remain uncontaminated and isolated from the environment.

The foregoing disclosure of embodiments of the present invention and specific examples illustrating the present invention have been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims appended hereto, and by their equivalents.

What is claimed:

1. An above-ground storage tank apparatus comprising:

(a) an internal storage tank for storing liquid received through an input port protruding therefrom;

(b) a secondary containment vessel surrounding the internal storage tank;

(c) a drain pipe extending through and protruding from the internal storage tank at a first and second location; and (d) a spill box connected to the internal storage tank and surrounding the input port and the drain pipe protruding from the internal storage tank;

wherein the spill box stores a first quantity of liquid that is spilled while the internal storage tank is being filled; and amounts of liquid greater than the first quantity of liquid are drained from the spill box through the drain pipe and into a containment area between the secondary containment vessel and the internal storage tank.

2. The above-ground storage tank apparatus according to claim 1, wherein the first location is at a top portion of the internal storage tank, and the second location is at a bottom portion of the internal storage tank.

3. The above-ground storage tank apparatus according to claim 1, further comprising:

(e) a plate atop the interior storage tank, formed around and connected to the spill box to allow liquid to be received in the storage tank through the input port; and (f) a sloping roof structure connected to the plate at a first end and connected to a wall of the secondary containment vessel at a second end;

wherein the plate, sloping roof structure, and secondary containment vessel together form a sealed containment area outside of the interior storage tank.

4. The above-ground storage tank apparatus according to claim 3, further comprising a manway located at a side wall of the secondary containment vessel;

wherein the manway is located a distance above of the floor of the secondary containment vessel to prevent liquid in the containment area from leaking when the manway is opened.

5. The above-ground storage tank apparatus according to claim 4, further comprising a pump for removing liquid from the containment area.

6. The above-ground storage tank apparatus according to claim 1, further comprising an alarm in the spill box for providing a signal when liquid is spilled from the input port during injection.

7. The above-ground storage tank apparatus according to claim 1, further comprising an alarm in the containment area for providing a signal when liquid is present in the containment area.

8. The above-ground storage tank apparatus according to claim 1, wherein a section of the drain pipe protruding into the spill box is adapted to connect to a tube to pressure test the containment area.

9. The above-ground storage tank apparatus according to claim 8, wherein a portion of the drain pipe is threaded.

10. The above-ground storage tank apparatus according to claim 1, further comprising:

(e) a vent pipe extending through and protruding from the internal storage tank at a third and fourth location for providing a vent from the containment area;

(f) a vent port protruding from the internal storage tank for providing a vent for the internal storage tank; and (g) a vent box connected to the internal storage tank and surrounding the vent port and the vent pipe protruding from the internal storage tank, wherein the vent box stores a first quantity of liquid that is vented from either the vent port or the vent pipe, and amounts of liquid greater than the first quantity of liquid are drained from the vent box through the vent pipe and into the containment area between the secondary containment vessel and the internal storage tank.

11. The above-ground storage tank apparatus according to claim 10, wherein the third location is at a top portion of the internal storage tank, and the fourth location is a bottom portion of the internal storage tank.

12. An above-ground containment system having a sealed secondary containment area, comprising:

(a) an internal storage tank for storing liquid received through an input port protruding therefrom;

(b) a secondary containment vessel surrounding the internal storage tank for storing liquid spilled from the input port;

(c) a drain pipe extending through and protruding from the internal storage tank at a first location near the input port and a second location in a secondary containment area between the internal storage tank and the secondary containment vessel;

(d) a spill box connected to the internal storage tank and surrounding the input port; and (e) a roofing structure extending from sides of the spill box to walls of the secondary containment vessel to seal the secondary containment area;

wherein the containment system can be pressure tested by applying pressure through the drain pipe at the first location.

13. The above-ground storage tank apparatus according to claim 12, further comprising a manway located at a side wall of the secondary containment vessel, wherein the manway is located a distance above of the floor of the secondary containment vessel to prevent liquid in the secondary containment area from making when the manway is opened.

14. The above-ground storage tank apparatus according to claim 12, further comprising a pump in the secondary containment area for removing liquid therefrom.

15. The above-ground storage tank apparatus according to claim 12, further comprising an alarm in the spill box for providing a signal when liquid is spilled from the input port during injection.

16. The above-ground storage tank apparatus according to claim 12, further comprising an alarm in the containment area for providing a signal when liquid is present in the containment area.

17. The above-ground storage tank apparatus according to claim 12, wherein a portion of the drain pipe is threaded.

18. The above-ground storage tank apparatus according to claim 12, wherein the height by which the drain pipe protrudes from the internal storage tank at the first location is adjustable.

* * * * *